US007567766B2

(12) United States Patent
Miyata et al.

(10) Patent No.: US 7,567,766 B2
(45) Date of Patent: Jul. 28, 2009

(54) FIXING DEVICE WITH TEMPERATURE CONTROL AND IMAGE FORMING APPARATUS

(75) Inventors: Toshiyuki Miyata, Kanagawa (JP); Motofumi Baba, Kanagawa (JP); Chikara Ando, Kanagawa (JP); Daisuke Yoshino, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 413 days.

(21) Appl. No.: 11/452,997

(22) Filed: Jun. 15, 2006

(65) Prior Publication Data

US 2007/0092277 A1 Apr. 26, 2007

(30) Foreign Application Priority Data

Oct. 24, 2005 (JP) ..... P2005-308952

(51) Int. Cl.
*G03G 15/20* (2006.01)

(52) U.S. Cl. ..... 399/69; 399/92; 399/329

(58) Field of Classification Search ..... 399/45, 399/69, 92, 329; 219/216
See application file for complete search history.

(56) References Cited

U.S. PATENT DOCUMENTS 7,043,185 B2 * 5/2006 Yoshikawa ..... 399/329
7,233,763 B2 * 6/2007 Shiraishi ..... 399/329
7,292,801 B2 * 11/2007 Yoshikawa ..... 399/69
7,319,838 B2 * 1/2008 Baba et al. ..... 399/329
7,361,863 B2 * 4/2008 Tsunoda ..... 219/216
2004/0264991 A1 12/2004 Yoshikawa ..... 399/69

FOREIGN PATENT DOCUMENTS

JP 3-133871 6/1991
JP 2001-194934 A 7/2001
JP 2003-5566 1/2003

* cited by examiner

*Primary Examiner*—William J Royer
(74) *Attorney, Agent, or Firm*—Morgan, Lewis & Bockius LLP

(57) ABSTRACT

A fixing device includes: a fixing roll member; a support roll member; a fixing belt member rotated while being mounted on and tensioned by the fixing roll member and the support roll member; a roll heating unit that heats the fixing roll member; a belt heating unit that heats the fixing belt member; a pressing member that is in press contact with a portion of the fixing roll member, around which the fixing belt member is wound, to form a nip portion; and a temperature controlling device that controls and drives the roll heating unit and the belt heating unit. The temperature controlling device controls the fixing roll member and the fixing belt member to be different temperatures.

15 Claims, 8 Drawing Sheets

FIXING DEVICE WITH TEMPERATURE CONTROL AND IMAGE FORMING APPARATUS

CROSS-REFERENCE TO RELATED APPLICATION

This application claims priority under 35 USC 119 from Japanese Patent Application No. 2005-308952, the disclosure of which is incorporated by reference herein.

BACKGROUND

1. Technical Field

The present invention relates to a fixing device that is used in an image forming apparatus in which, for example, the electrophotographic system is employed, and more particularly to a fixing device that includes a rotatable belt member.

2. Related Art

In an image forming apparatus in which the electrophotographic system is used, such as a copier or a printer, image formation is performed in the following manner. First, the surface of a photosensitive member (photosensitive drum), which is formed into, for example, a drum-like shape, is uniformly charged by a charging device. The charged photosensitive drum is scan-exposed to light, which is controlled based on image information, and an electrostatic latent image is formed in the surface. The electrostatic latent image formed on the photosensitive drum is converted to a visible image (toner image) by a developing device. Then, the toner image is transported to a transfer station in accordance with rotation of the photosensitive drum and electrostatically transferred onto a recording sheet serving as a recording medium. Thereafter, a fixing process is applied on the toner image carried on the recording sheet, by a fixing device, and then an image is completed.

In a fixing device that is used in such an image forming apparatus, usually, a configuration that is called the two-roll system is widely used. A fixing device of the two-roll system is configured so that a fixing roll and a pressing roll are in press contact with each other. The fixing roll is formed by stacking a heat-resistant elastic layer and a separation layer on the surface of a cylindrical metal core, in which a heating source (heater) is placed. The pressing roll is formed by stacking a heat-resistant elastic layer and a separation layer formed by a heat-resistant resin film or a heat-resistant rubber film on a metal core. A recording sheet carrying an unfixed toner image is passed through a press contact region (nip portion) between the fixing roll and the pressing roll to heat and pressurize the unfixed toner image, thereby fixing the toner image.

In the field of an image forming apparatus, recently, enhancement of productivity and colorization are rapidly advancing, and an image forming apparatus having a double-sided printing mechanism is widely used. Also in a fixing device to be mounted on an image forming apparatus, therefore, a countermeasure against an increased speed is required to be further advanced.

However, a conventional fixing device of the two-roll system has a problem in that a sufficient fixing process is hardly performed on a large number of recording sheets that are consecutively fed at high speed. Namely, in a fixing device of the two-roll system, a metal core constituting a fixing roll, and an elastic layer made of silicone rubber or the like covering the metal core function as a thermal resistor. In a fixing device of the two-roll system, therefore, it is structurally difficult that a heater disposed inside a fixing roll supplies adaptively and sufficiently a quantity of heat corresponding to that which is captured by the recording sheet from the surface of the fixing roll.

As a result, when recording sheets are consecutively fed at high speed to a fixing device of the two-roll system, there arises a disadvantage that the surface temperature of a fixing roll is gradually lowered, and the fixing performance is progressively impaired. In a starting period of an image forming apparatus, so-called "temperature droop phenomenon" in which the surface temperature of a fixing roll temporarily drops easily occurs. When a thick sheet or the like having a large heat capacity is used as a recording sheet, particularly, a large quantity of heat is captured from the surface of the fixing roll, and hence the reduction of the fixing performance and the temperature droop are increased, with the result that deterioration of the image quality due to a fixing failure occurs.

A technique for realizing a fixing device that solves the above-mentioned problems caused when a fixing device of the two-roll system is used and that deals with the speeding up of an image forming apparatus has been developed. For example, there is a technique relating to a fixing device in which a heating member for heating a recording sheet is configured by a film-like belt member (fixing belt) mounted on and tensioned by plural support rolls.

Recording sheets have different heat capacities depending on the property such as the thickness. Therefore, the quantity of heat that is captured from the fixing belt by a recording sheet during the fixing process is different depending on, for example, the thickness. When compared with the case where sheets are consecutively passed at a process speed (sheet passing speed) and a set temperature that are set with reference to a thin recording sheet (thin sheet), a thick recording sheet (thick sheet) has a heat capacity larger than that of a thin sheet, and the quantity of heat that is used for fixing a toner is reduced. Therefore, there may arise a disadvantage that a fixing failure easily occurs.

A configuration where the process speed is switched over in accordance with the thickness of a recording sheet may be contemplated. Namely, in the case of a thick sheet, the process speed is set to be slower than the case of a thin sheet, so that the quantity of heat captured from the fixing roll by the recording sheet is suppressed, thereby preventing the temperature of the fixing roll from being lowered.

In the configuration where the process speed is switched over in cases of a thin sheet and a thick sheet in this way, however, the operating efficiency of the case of a thick sheet is lower than that of the case of a thin sheet.

By contrast, a configuration where the process speed is maintained constant and the set temperatures of the fixing belt and fixing roll are switched over in accordance with the thickness of a recording sheet (the temperatures are made higher in the case of a thick sheet) may be contemplated.

When it is configured so that the set temperatures are switched over in accordance with the sheet thickness, however, there is a problem that the switching process requires a time period. In the case where a thin sheet is switched to a thick sheet, a temperature rise time period that is considerably long elapses before the fixing roll-reaches a higher set temperature, because it is difficult to rapidly heat the fixing roll having a large heat capacity. By contrast, in the case where a thick sheet is switched to a thin sheet, a temperature fall time that is considerably long elapses before the fixing roll reaches a lower set temperature. Consequently, there is a problem that the operating efficiency is inevitably lowered.

SUMMARY

According to an aspect of the invention, there is provided a fixing device that fixes a toner image on a recording medium, including: a rotatable fixing roll member; a rotatable support roll member; a fixing belt member that is rotated while being mounted on and tensioned by the fixing roll member and the support roll member; a roll heating unit that heats the fixing roll member; a belt heating unit that heats the fixing belt member; a pressing member that is in press contact with a portion of the fixing roll member, around which the fixing belt member is wound, to form a nip portion; and a temperature controlling device that controls and drives the roll heating unit and the belt heating unit, the temperature controlling device controlling the fixing roll member and the fixing belt member to be different temperatures.

BRIEF DESCRIPTION OF THE DRAWINGS

Embodiments of the present invention will be described in detail based on the following figures, wherein.

DETAILED DESCRIPTION

Hereinafter, an exemplary embodiment of the invention will be described in detail referring to the accompanying drawings.

Figure 1:
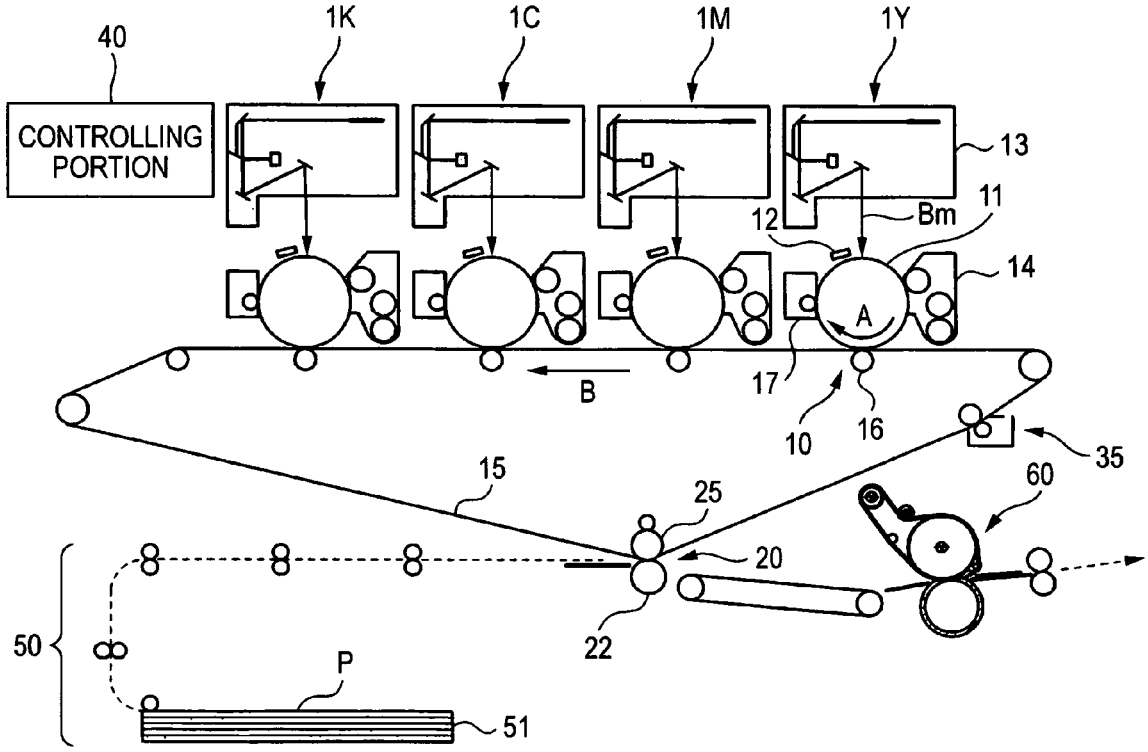
FIG. 1 is a schematic diagram of an image forming apparatus according to an exemplary embodiment of the invention.

FIG. 1 is a schematic diagram of an image forming apparatus 1 to which the exemplary embodiment is applied.

The image forming apparatus 1 shown in FIG. 1 is an intermediate-transfer image forming apparatus which is of the so-called tandem type, and includes: plural image forming units 1Y, 1M, 1C, 1K serving as a toner-image forming unit for forming toner images of respective color components by an electrophotographic system; and a primary transfer station 10 which sequentially transfers (primarily transferred) toner images of respective color components formed by the image forming units 1Y, 1M, 1C, 1K, to an intermediate transfer belt 15. The image forming apparatus 1 further includes: a secondary transfer station 20 serving as a transferring unit for collectively transferring (secondarily transferred) superimposed toner images which have been transferred onto the intermediate transfer belt 15, to a recording sheet P serving as a recording medium; and a fixing device 60 which fixes the images that have been secondarily transferred, onto the recording sheet P. Furthermore, the image forming apparatus 1 has a recording-sheet transporting mechanism 50, and a controlling portion 40 which controls operations of the above-mentioned devices (portions).

Each of the image forming units 1Y, 1M, 1C, 1K includes a photosensitive drum 11 which is rotated in the direction of the arrow A, as typically shown in the image forming unit 1Y in the figure. A charging device 12 which charges the photosensitive drum 11, a laser exposing device 13 which draws an electrostatic latent image onto the photosensitive drum 11 (an exposure beam is indicted by a reference character Bm in the figure), and a developing device 14 which stores a toner of a corresponding color component, and which visualizes the electrostatic latent image on the photosensitive drum 11 by means of the toner are arranged around the photosensitive drum 11. A primary transfer roller 16 which transfers the toner image of the corresponding color component formed on the photosensitive drum 11, to the intermediate transfer belt 15 in the primary transfer station 10, and a drum cleaner 17 which removes away a residual toner on the photosensitive drum 11 are disposed. The image forming units 1Y, 1M, 1C, 1K are arranged in a substantially linear manner in the sequence of yellow (Y), magenta (M), cyan (C), and black (K) with starting from the upstream side of the intermediate transfer belt 15.

The intermediate transfer belt 15 is mounted on and tensioned by various rolls in a path which substantially linearly elongates along the arrangement direction of the photosensitive drums 11, and cyclically driven (revolved) at a predetermined speed in the direction of the arrow B in FIG. 1.

The primary transfer station 10 is configured by the primary transfer rollers 16 which are opposed to the respective photosensitive drums 11 across the intermediate transfer belt 15. The primary transfer rollers 16 cause the intermediate transfer belt 15 to be in press contact with the photosensitive drums 11. A voltage (primary transfer bias) which has a polarity opposite to the charging polarity of the toner is applied to the primary transfer rollers 16. According to the configuration, toner images on the photosensitive drums 11 are sequentially electrostatically attracted to the intermediate transfer belt 15 to form the toner images on the intermediate transfer belt 15 in a superimposed manner.

The secondary transfer station 20 is configured by a secondary transfer roll 22 which is placed on the side of the toner-image carrying face of the intermediate transfer belt 15, and a backup roll 25 which is opposed to the secondary transfer roll 22 across the intermediate transfer belt 15.

A secondary transfer bias is applied to the backup roll 25, and the secondary transfer roll 22 is grounded so that the secondary transfer bias is formed between the secondary transfer roll 22 and the backup roll 25. The toner image carried by the intermediate transfer belt 15 is secondarily transferred onto the recording sheet P which is fed.

An intermediate-transfer-belt cleaner 35 which removes away a residual toner and paper dust on the intermediate transfer belt 15 after the secondary transfer, to clean the surface of the intermediate transfer belt 15 is disposed on the downstream side of the secondary transfer station 20 of the intermediate transfer belt 15.

The recording-sheet transporting mechanism 50 transports the recording sheet P from a recording-sheet tray 51 accommodating the recording sheet P, to the secondary transfer station 20, and transports the recording sheet P onto which the toner image has been transferred (secondarily transferred) in the secondary transfer station 20, to the fixing device 60.

The thus configured image forming apparatus 1 forms an image in the following manner.

On the basis image data output from an image reading apparatus which is not shown or a personal computer which is not shown, the image forming units 1Y, 1M, 1C, 1K form images of the respective colors on the respective photosensitive drums 11. The toner image formation in each of the image forming units 1Y, 1M, 1C, 1K is performed in the following manner. The photosensitive drum 11 which has been charged by the charging device 12 is scan-exposed by the laser exposing device 13 so that an electrostatic latent image is formed. The electrostatic latent image is developed by the developing device 14 to form a toner image.

The toner images formed on the photosensitive drums 11 of the image forming units 1Y, 1M, 1C, 1K are transferred in a superimposed manner onto the intermediate transfer belt 15 in the primary transfer station 10.

The toner images which have been formed in a superimposed manner on the surface of the intermediate transfer belt 15 are moved to the secondary transfer station 20 as a result of revolving of the intermediate transfer belt 15, and collectively electrostatically transferred in the secondary transfer station 20 onto the recording sheet P which is transported by the recording-sheet transporting mechanism 50.

The recording sheet P onto which the toner images have been-transferred is transported to the fixing device 60 by the recording-sheet transporting mechanism 50, and subjected by the fixing device 60 to a fixing process due to heat and pressure, thereby fixing the toner images. The recording sheet P onto which the toner images have been fixed is discharged to a sheet discharge portion (not shown) disposed in a discharge port of the image forming apparatus 1.

Next, the fixing device 60 used in the image forming apparatus 1 of the exemplary embodiment will be described.

Figure 2:
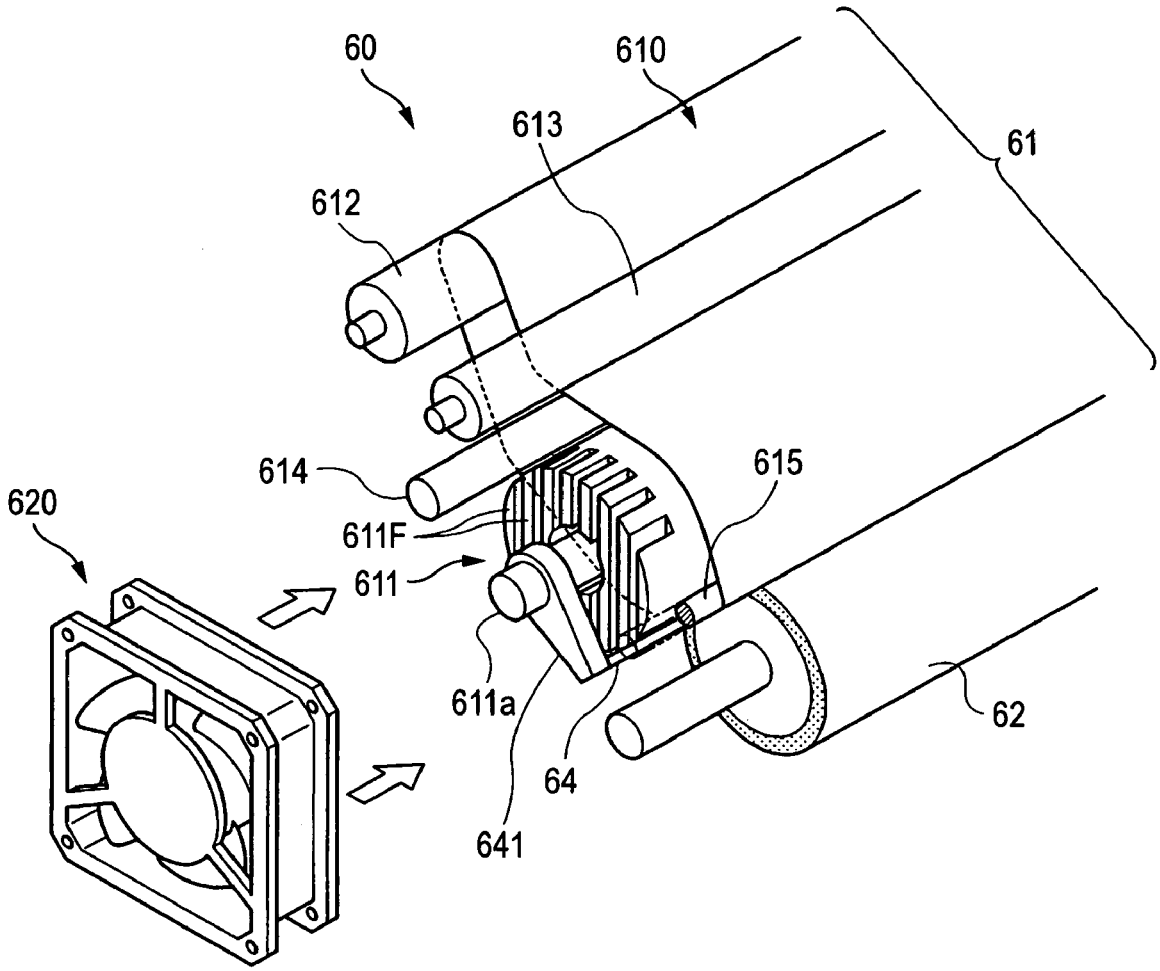
FIG. 2 is a perspective view conceptually showing one end portion of a fixing device.
Figure 3:
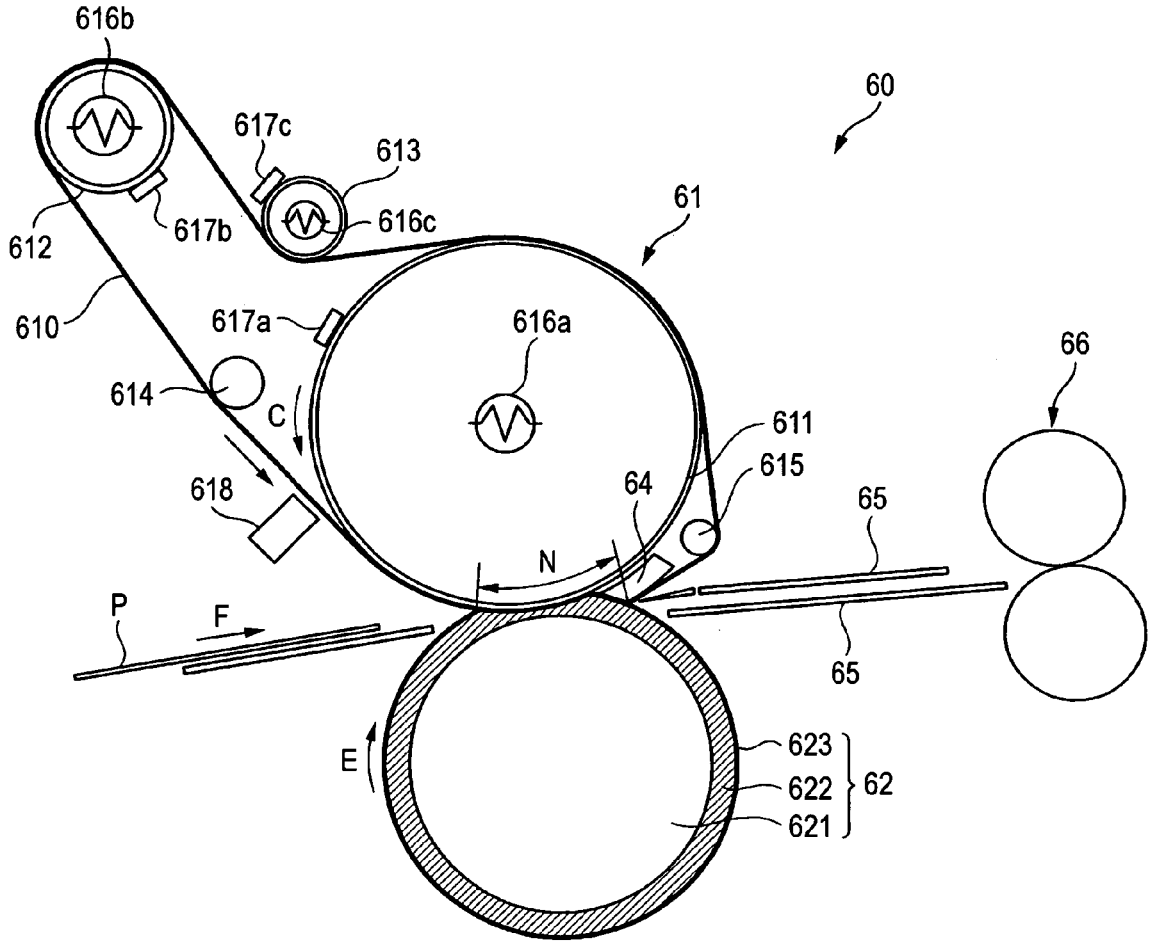
FIG. 3 is a side sectional view showing a schematic configuration of the fixing device.
Figure 4:
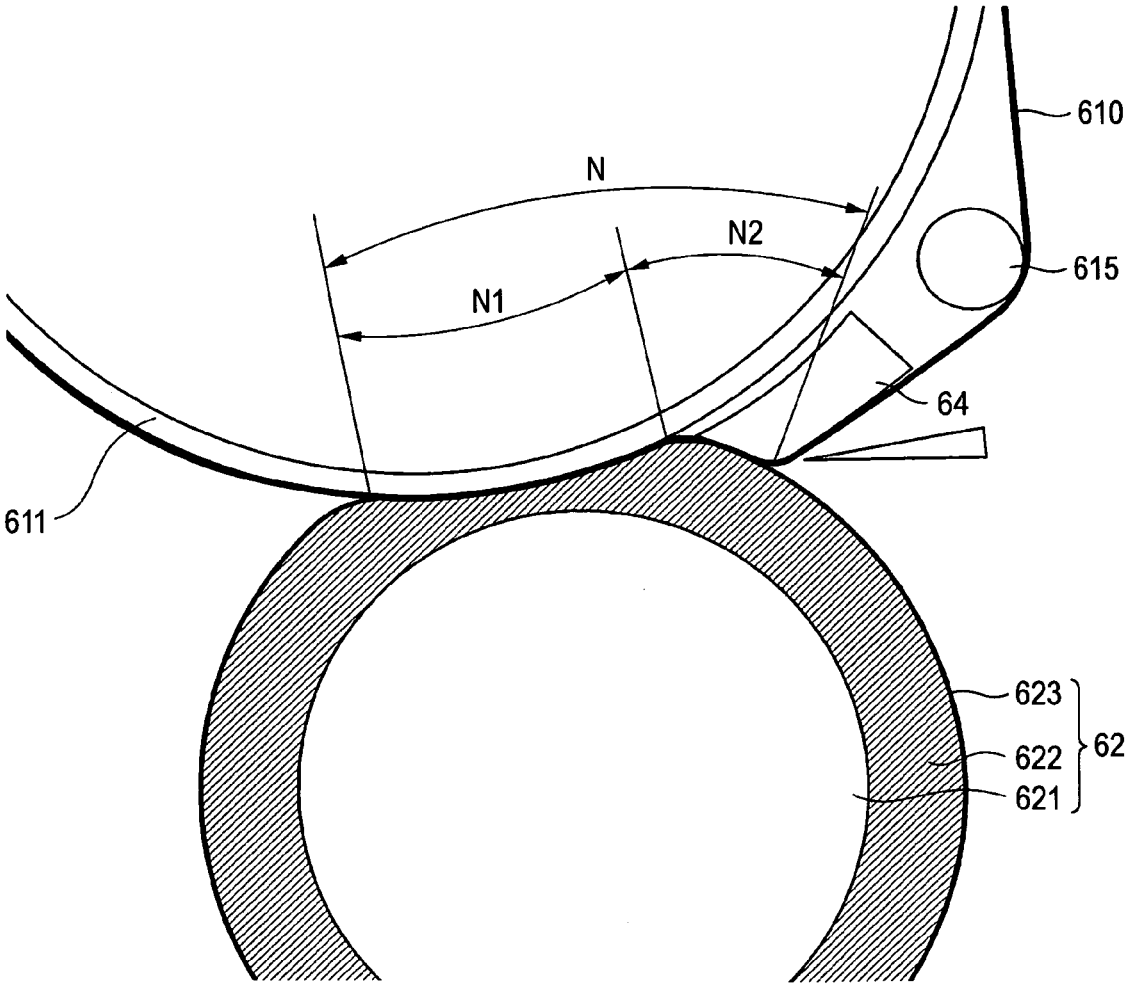
FIG. 4 is a schematic sectional view showing a region in the vicinity of a nip portion.
Figure 5:
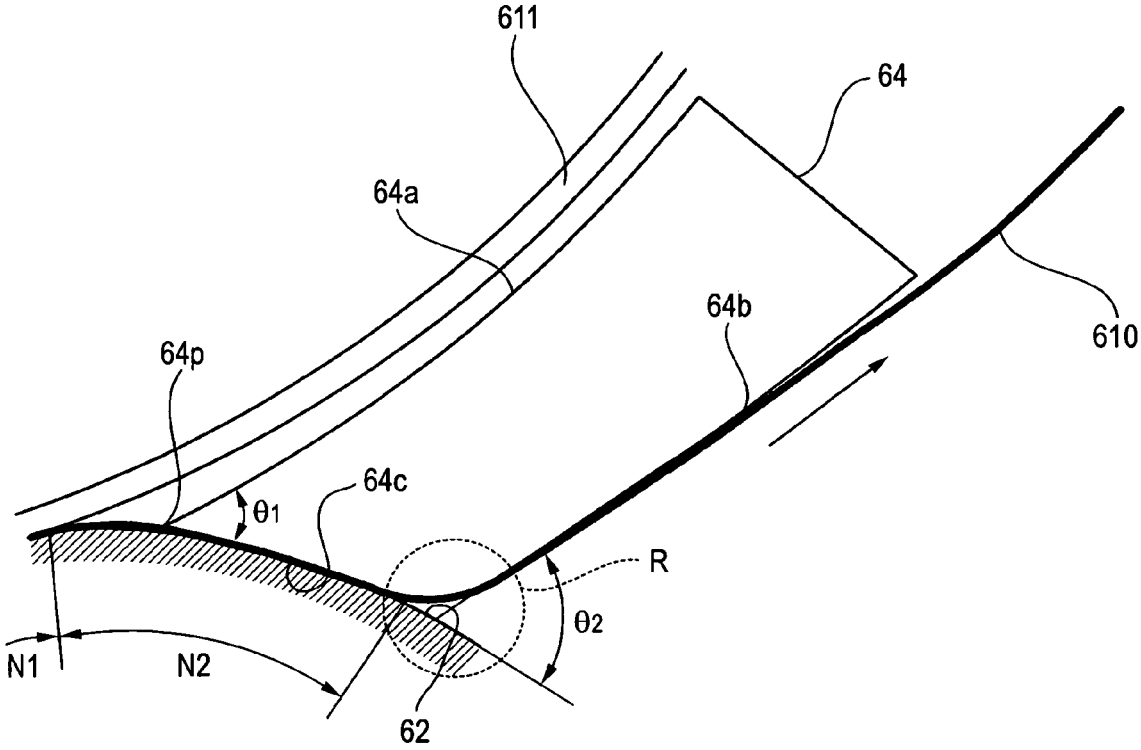
FIG. 5 is a schematic sectional view showing a periphery of a region where a separation pad is placed.
Figure 6:
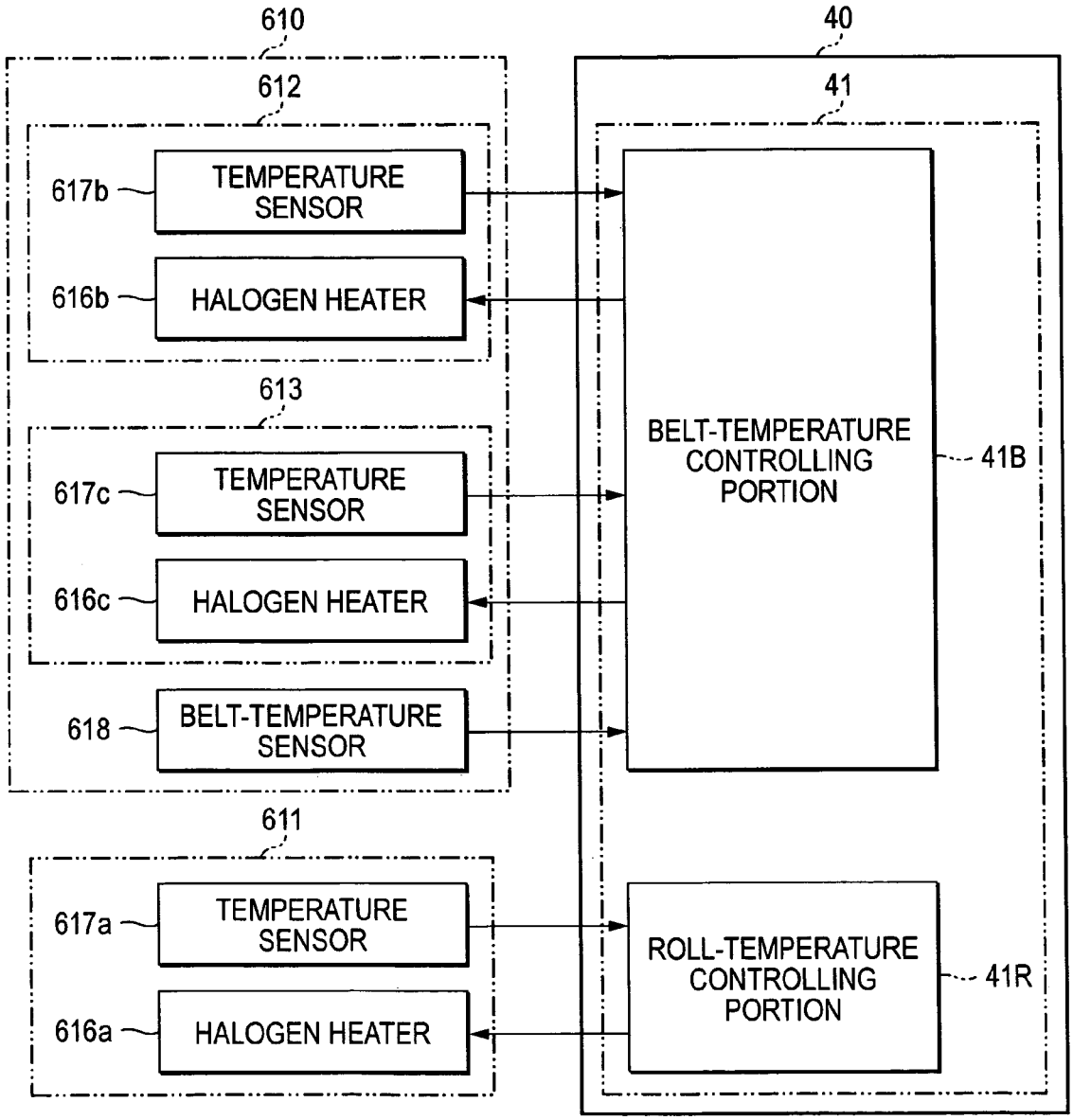
FIG. 6 is a block diagram of a temperature control configuration of the fixing device.

FIG. 2 is a perspective view conceptually showing one end portion of the fixing device 60, FIG. 3 is a side sectional view showing a schematic configuration of the fixing device 60, FIG. 4 is a schematic sectional view showing a region in the vicinity of a nip portion N, FIG. 5 is a schematic sectional view showing a periphery of a region where a separation pad 64 is placed, and FIG. 6 is a block diagram of a temperature control configuration of the fixing device 60.

The fixing device 60 is configured by: a fixing belt module 61 including a fixing belt 610 serving as a fixing belt member; and a pressing roll 62 serving as a pressing member which is disposed in press contact with the fixing belt module 61.

The fixing belt module 61 includes: the fixing belt 610 serving as the fixing belt member; a fixing roll 611 serving as a fixing roll member which rotates the fixing belt 610 while giving tension thereto; and a support roll 612 serving as a support roll member which gives tension to the fixing belt 610 from the inner side. The fixing belt module further includes: a support roll 613 which is disposed outside the fixing belt 610 to define the circulation path of the fixing belt 610; and a posture-correcting roll 614 which corrects the posture of the fixing belt 610 between the fixing roll 611 and the support roll 612. The fixing belt module further includes: the separation pad 64 serving as a separating member which is placed in the vicinity of the fixing roll 611 and in a downstream side of the nip portion N where the fixing belt module 61 and the pressing roll 62 are in press contact with each other; and a support roll 615 which gives tension to the fixing belt 610 on the downstream side of the nip portion N.

The fixing belt 610 is a flexible endless belt having a circumference length of 314 mm and a width of 340 mm, and configured by: a base layer formed by a polyimide resin having a thickness of 80 μl; an elastic layer made of silicone rubber having a thickness of 200 μm and stacked on the surface (outer peripheral face) of the base layer; and a separation layer made of a tube of tetrafluoroethylene-perfluoroalkylvinyl ether copolymer resin (PFA) having a thickness of 30 μm covering the elastic layer. The elastic layer is disposed in order to improve the image quality of, particularly, a color image. In the configuration of the fixing belt 610, the material, the thickness, the hardness, and the like are adequately selected in accordance with device design conditions such as the purpose of use, the conditions of use, etc.

A belt-temperature sensor 618 which is of the non-contact type is disposed just before a portion where the fixing belt 610 is wound around the fixing roll 611. The belt-temperature sensor 618 measures the temperature of the portion which is just before the winding of the fixing belt 610 around the fixing roll 611, and outputs the measurement result as control information to a temperature controlling portion 41 (see FIG. 6) which is configured inside the controlling portion 40 (see FIG. 1) of the image forming apparatus 1, and which is described later.

The fixing roll 611 is a hard roll in which a protective layer for preventing the surface from abrasion is formed on a cylindrical core roll (metal core) made of aluminum. In the exemplary embodiment, the core roll has an outer diameter of 65 mm, a length of 360 mm, and a thickness of 10 mm. The protective layer is a film of a fluororesin having a thickness of 200 μm. However, the fixing roll 611 is not restricted to this configuration. The configuration is requested at least to function as a roll which is sufficiently hard so that, when the roll cooperates with the pressing roil 62 to form the nip portion N, it is not substantially deformed by a pressing force applied from the pressing roll 62. The fixing roll 611 is rotated by a driving motor which is not shown, at a surface velocity of 440 mm/s in the direction of the arrow C.

A halogen heater 616*a* which is a roll heating unit or a roll heater, and which has a rating of 900 W is disposed in the fixing roll 611. A temperature sensor 617*a* is disposed so as to be in contact with the surface of the fixing roll 611. The temperature sensor 617*a* detects the temperature of the fixing roll 611, and outputs the detection result as control information to the temperature controlling portion 41 (see FIG. 6) in the controlling portion 40 (see FIG. 1).

As shown in FIG. 2, many radiating fins 611F are formed on a side end portion of the fixing roll 611. A cooling fan 620 which blows cooling air toward the radiating fins 611F is disposed so as to oppose the side end portion of the fixing roll 611. The radiating fins 611F and the cooling fan 620 are disposed in both side end portions of the fixing roll 611, and they constitute a cooling unit in the exemplary embodiment.

According to the configuration, the fixing roll 611 is heated by the halogen heater 616*a*, and cooled by the air blown to the radiating fins 611F by the cooling fans 620.

On the basis of detection temperature information obtained by the temperature sensor 617*a*, the fixing roll 611 is controlled by the temperature controlling portion 41 to a predetermined surface temperature. The temperature control will be described later in detail.

The support roll 612 is a cylindrical roll which is formed by aluminum so as to have an outer diameter of 30 mm, a thickness of 2 mm, and a length of 360 mm.

A halogen heater 616*b* which is a belt heating unit or a belt heater, and which has a rating of 1,000 W is disposed in the support roll 612. A temperature sensor 617*b* is disposed so as to be in contact with the surface of the support roll 612. The temperature sensor 617*b* detects the temperature of the support roll 612, and outputs the detection result as control information to the temperature controlling portion 41.

On the basis of detection temperature information obtained by the temperature sensor 617*b*, the support roll 612 is controlled by a belt-temperature controlling portion 41B to a predetermined surface temperature. Namely, the support roll 612 has both functions of giving tension to the fixing belt 610, and heating the fixing belt 610 from the inner side.

A spring member (not shown) which outward presses the fixing belt 610 is disposed in both end portions of the support roll 612, to set the tension of the whole fixing belt 610 to 15 kgf.

The support roll 612 is provided with an axial displacement mechanism which displaces the contacting position in the axial direction of the fixing belt 610 in accordance with a detection result of a belt-edge position detection mechanism, whereby meandering (belt walk) of the fixing belt 610 is controlled.

The support roll 613 is a cylindrical roll which is formed by aluminum so as to have an outer diameter of 25 mm, a thickness of 2 mm, and a length of 360 mm. A separation layer made of a fluororesin having a thickness of 20 μm is formed in the surface of the support roll 613. The separation layer is formed in order to prevent even a small amount of offset toner or paper powder originated from the outer peripheral face of the fixing belt 610, from accumulating on the support roll 613.

A halogen heater 616*c* which is a belt heating unit or a belt heater, and which has a rating of 1,000 W is disposed in the support roll 613. A temperature sensor 617*c* is disposed so as to be in contact with the surface of the support roll 613. The temperature sensor 617*c* detects the temperature of the support roll 613, and outputs the detection result as control information to the temperature controlling portion 41.

On the basis of detection temperature information obtained by the temperature sensor 617*c*, the support roll 613 is controlled by the temperature controlling portion 41 to a predetermined surface temperature. Namely, the support roll 613 has both functions of giving tension to the fixing belt 610, and heating the fixing belt 610 from the inner side.

In the exemplary embodiment, therefore, the fixing belt 610 is heated by the fixing roll 611, the support roll 612, and the support roll 613.

The posture-correcting roll 614 is a columnar roll which is formed by stainless steel alloy so as to have an outer diameter of 15 mm and a length of 360 mm. The belt-edge position detection mechanism (not shown) which detects an edge position of the fixing belt 610 is placed in the vicinity of the posture-correcting roll 614.

The separation pad 64 is a block member which is formed by a rigid member of a metal such as SUS, a resin, or the like, and which has a substantially arcuate section shape. As shown in FIG. 2, both ends of the separation pad 64 are supported by arms 641 which are swingably fitted to support shafts 611*a* of the fixing roll 611. The separation pad 64 is fixedly placed over the whole axial range of the fixing roll 611 in the vicinity of the downstream side of "roll nip portion N1" (see FIG. 4 which will be described later) or a region where the pressing roll 62 is in press contact with the fixing roll 611 via the fixing belt 610. The separation pad 64 is disposed so as to uniformly press the pressing roll 62 via the fixing belt 610 at a predetermined load (for example, 10 kgf) over a predetermined width region, and forms "separation-pad nip portion N2" which will be described later.

As shown in FIG. 5, the separation pad 64 includes: an inner side face 64*a* which faces the fixing roll 611; an outer side face 64*b* which abruptly changes the traveling direction of the fixing belt 610; and a pressing face 64*c* which presses the fixing belt 610 against the pressing roll 62.

The inner side face 64*a* of the separation pad 64 is formed by a curved face which extends along the circumferential face of the fixing roll 611, in order to allow the separation pad 64 to be placed close to the fixing roll 611 as far as possible (for example, the gap between the separation pad 64 and the fixing roll 611 is 0.5 mm). An upstream end portion 64*p* of the inner side face 64*a* is set at a position which is close to the fixing roll 611. In order to ensure the strength and rigidity of the upstream end portion 64*p*, it is preferable to set the angle θ1 formed by the inner side face 64*a* and the pressing face 64*c* to a range of 20 to 50°.

The pressing face 64*c* of the separation pad 64 is a face which presses the fixing belt 610 against the pressing roll 62 to be in press contact with the surface of the pressing roll 62. Therefore, the pressing face 64*c* is formed by a flat face so that the fixing belt 610 is uniformly pressed against the pressing roll 62. Alternatively, the pressing face 64*c* may be formed by a concave curved face which extends along the circumferential face of the pressing roll 62, whereby the pressing force can be further uniformalized.

The outer side face 64*b* of the separation pad 64 is a face which cooperates with the support roll 615 and the fixing roll 611 to guide the fixing belt 610, and which separates the recording sheet P from the fixing belt 610 by abruptly changing the traveling direction of the fixing belt 610. In order to stably separate the recording sheet P from the fixing belt 610, therefore, the angle θ2 (see FIG. 5) formed by a tangential line of the pressing roll 62 and that of the outer side face 64*b* is set to 40° r more in an upstream end region R (where the fixing belt 610 separates from the pressing roll 62) of the outer side face 64*b*. The outer side face 64*b* in the upstream end region R is formed by a curved face so as to enable the fixing belt 610 to smoothly move in the upstream end region R where the face is abruptly bent.

Furthermore, the outer side face 64*b* is formed by a flat face which is inclined toward the support roll 615 so that, after the fixing belt 610 separates from the pressing roll 62, the fixing belt 610 smoothly travels in the direction of the support roll 615 and the fixing roll 611. In this case, the outer side face 64*b* may be formed by a curved face which is bent toward the outer side (the side of the fixing belt 610).

The support roll 615 is a columnar roll which is formed by stainless steel alloy so as to have an outer diameter of 12 mm and a length of 360 mm. The support roll 615 is placed in the vicinity of the downstream side of the separation pad 64 in the traveling direction of the fixing belt 610 so that the fixing belt 610 which has passed over the separation pad 64 smoothly revolves toward the fixing roll 611.

The pressing roll 62 is a soft roll in which a columnar roll 621 formed by aluminum so as to have a diameter of 45 mm and a length of 360 mm is used as a base member, and which is configured by, starting from the side of the base member, stacking an elastic layer 622 having a thickness of 10 mm and made of silicone rubber having a rubber hardness of 30° (JIS-A), and a separation layer 623 formed by a PFA tube having a film thickness of 100 μm. The pressing roll 62 is disposed so as to be pressed against the fixing belt module 61, and revolves in the direction of the arrow E in accordance with the rotation in the direction of the arrow C of the fixing roll 611 of the fixing belt module 61. The traveling velocity is 440 mm/s which is equal to the surface velocity of the fixing roll 611.

Then, the nip portion N where the fixing belt module 61 and the pressing roll 62 are in press contact with each other will be described.

As shown in FIG. 4, in the nip portion N where the fixing belt module 61 (see FIG. 3) and the pressing roll 62 are in press contact with each other, the pressing roll 62 is placed so as to be in press contact with the outer peripheral face of the fixing belt 610 in a region (wrap region) where the fixing belt 610 is wound (wrapped) around the fixing roll 611, whereby the roll nip portion N1 is formed.

In the fixing device 60 of the exemplary embodiment, as described above, the fixing roll 611 which is the one of the rolls constituting the roll nip portion N1 is a hard roll that is configured by covering the surface of the metal core (core roll) of aluminum by a heat-resistant resin (fluororesin), and the fixing roll 611 is not covered by an elastic layer. The pressing roll 62 forming the roll nip portion N1 is a soft roll which is covered by the elastic layer 622.

In this configuration of the fixing roll 611 and the pressing roll 62, the roll nip portion N1 in the exemplary embodiment is formed by deformation of the elastic layer 622 of the pressing roll 62, and functions as a roll (NIP Forming Pressure Roll) for enabling the side of the pressing roll 62 to form a nip.

Namely, in the roll nip portion N1, a state where a depression is not substantially formed in the fixing roll 611 and only the surface of the pressing roll 62 is largely depressed (the depression amount of the pressing roll 62>the depression amount of the fixing roll 611) is produced, so that a nip region having a predetermined width in the traveling direction of the fixing belt 610 is formed.

In the fixing device 60 of the exemplary embodiment, as described above, the fixing roll 611 which is on the side where the fixing belt 610 is wrapped in the roll nip portion N1 is not substantially deformed, and maintains its cylindrical shape. Therefore, the fixing belt 610 revolves along the circumferential face of the surface of the fixing roll 611, and the revolving radius of the fixing belt 610 is not varied. Consequently, the fixing belt 610 can pass through the roll nip portion N1 while maintaining the traveling velocity to be constant. Also when the fixing belt 610 passes through the roll nip portion N1, wrinkles and distortion are very hardly produced in the fixing belt 610. As a result, formation of disturbance in a fixed image can be suppressed, and a fixed image of high quality can be stably provided. In the fixing device 60 of the exemplary embodiment, the roll nip portion N1 is set to 15 mm (i.e., the nip width is 15 mm) in the traveling direction of the fixing belt 610.

The separation pad 64 is disposed in the vicinity of the downstream side of the roll nip portion N1, and presses the fixing belt 610 against the surface of the pressing roll 62. In the downstream side of the roll nip portion N1, therefore, the separation-pad nip portion N2 where the fixing belt 610 is wrapped around the surface of the pressing roll 62 is formed continuously with the roll nip portion N1.

The fixing belt 610 which has passed through the separation-pad nip portion N2 revolves along the side face of the separation pad 64. Therefore, the traveling direction of the fixing belt 610 is abruptly changed by the separation pad 64 so as to be bent in the direction of the support roll 615. As a result, the recording sheet P which has passed through the roll nip portion N1 and the separation-pad nip portion N2 cannot follow the change of the traveling direction of the fixing belt 610 at the timing when the recording sheet P passes through the separation-pad nip portion N2, and is separated from the fixing belt 610 by so-called "stiffness" of the recording sheet P itself. In this way, in the exit of the separation-pad nip portion N2, the curvature separation is stably performed on the recording sheet P. In the fixing device 60 of the exemplary embodiment, the separation-pad nip portion N2 is set to 5 mm (i.e., the nip width is 5 mm) in the traveling direction of the fixing belt 610.

In the fixing device 60 of the exemplary embodiment, the nip portion N where the fixing process is conducted is set to 20 mm in total by the roll nip portion N1 of 15 mm and the separation-pad nip portion N2 of 5 mm.

Next, the temperature control configuration of the fixing device 60 will be described referring to FIG. 6. The reference numerals of the components are identical with those of FIGS. 2 to 5.

In the fixing device 60 of the exemplary embodiment, as described above, the fixing belt 610 is heated by the fixing roll 611, the support roll 612, and the support roll 613. The temperature of the fixing belt 610 is controlled by the temperature controlling portion 41 serving as a temperature controlling device which is configured in the controlling portion 40. The temperature controlling portion 41 is configured by a roll-temperature controlling portion 41R and the belt-temperature controlling portion 41B.

On the basis of the detection temperature information supplied from the temperature sensor 617*a* which detects the surface temperature of the fixing roll 611, the roll-temperature controlling portion 41R feedback-controls the halogen heater 616*a* disposed in the fixing roll 611, and the cooling fans 620 disposed outside the side end portions of the fixing roll 611, to control the fixing roll 611 so as to maintain the fixing roll 611 at the set temperature.

On the basis of the detection temperature information supplied from the temperature sensors 617*b*, 617*c* which detect respectively the surface temperatures of the support rolls 612, 613, the belt-temperature controlling portion 41B feedback-controls the halogen heaters 616*b*, 616*c* disposed in the support rolls 612, 613, to control the support rolls 612, 613 so as to maintain the support rolls 612, 613 at the set temperatures, respectively. On the basis of the detection temperature information supplied from the belt-temperature sensor 618 which detects the temperature of the fixing belt 610, the belt-temperature controlling portion further controls the temperature of the portion which is just before the winding of the fixing belt 610 around the fixing roll 611, at the set temperature.

In accordance with the property of a recording sheet P which is used in the image formation (the thickness in the exemplary embodiment), the roll-temperature controlling portion 41R and the belt-temperature controlling portion 41B independently control the fixing roll 611, and the support roll 612 and the support roll 613 (i.e., the fixing belt 610) to different set temperatures.

Namely, the roll-temperature controlling portion 41R controls the temperature of the fixing roll 611 to 150° C. in the case of a thin sheet, and to 170° C. in the case of a thick sheet. The belt-temperature controlling portion 41B controls the temperatures of the support rolls 612, 613 to 150° C. in the case of a thin sheet, and to 250° C. in the case of a thick sheet. In the case of a thin sheet, the fixing belt 610 is heated by the fixing roll 611 and the support rolls 612, 613 to 150° C., and, in the case of a thick sheet, heated mainly by the support rolls 612, 613 to 250° C. For example, a thin sheet is thin coated paper having a basis weight of 85 g/m$^2$, and a thick sheet is thick coated paper having a basis weight of 256 g/m$^2$. The set values in the roll-temperature controlling portion 41R and the belt-temperature controlling portion 41B based on the thickness of the recording sheet P are switched over by designating the values through an operation panel by the operator.

Next, the reason why the temperature control configuration is employed, and the function of the configuration will be described.

In the fixing device 60 of the exemplary embodiment, the fixing process is conducted by heat which is applied in the nip portion N from the fixing belt 610 to the recording sheet. Therefore, the temperature of the fixing belt 610 is determined from the quantity of heat which is required in fixing in the nip portion N, and which is derived from the sheet passing speed (nip passing time), and the heat capacity of the recording sheet P. When the sheet passing speed is constant, therefore, the temperature of the fixing belt 610 must be adjusted in accordance with the heat capacity of the recording sheet P. Namely, in the case of a thick sheet having a heat capacity which is larger than that of a thin sheet, the temperature of the fixing belt 610 must be set higher than the case of a thin sheet.

In the exemplary embodiment in which the nip portion N has a width of 20 mm and the sheet passing speed is 440 mm/s, the temperature of the fixing belt 610 is 150° C. in the case of thin coated paper having a basis weight of 85 g/m$^2$, and 220° C. in the case of thick coated paper having a basis weight of 256 g/m$^2$.

The fixing belt 610 is heated by; heat which is supplied through the fixing roll 611 from the halogen heater 616*a* disposed in the fixing roll 611; which is supplied through the support roll 612 from the halogen heater 616*b* disposed in the support roll 612; and which is supplied through the support roll 613 from the halogen heater 616*c* disposed in the support roll 613. In a configuration where, in accordance with a thick sheet and a thin sheet, the temperature of the fixing belt 610 is switched over by similarly controlling the temperatures of all the heating elements (the fixing roll 611 and the support rolls 612, 613), when the recording sheet P is to be changed from a thin sheet to a thick sheet, the temperatures of all the heating elements must be raised from 150° C. to 220° C. By contrast, when the recording sheet P is to be changed from a thick sheet to a thin sheet, the control must wait until the temperatures of all the heating elements are lowered from 220° C. to 150° C. In such a case, the longest time period is required for raising/lowering the fixing roll 611 which has the largest heat capacity.

In the exemplary embodiment, therefore, the temperature adjustment range of the fixing roll 611 which requires a prolonged time period because of the largest heat capacity is set to be narrow, and the temperature adjustment ranges of the support rolls 612, 613 (i.e., the fixing belt 610) in which the heat capacity is small and the temperature can be easily changed are set to be wide, so as to obtain the quantity of heat which is required in fixing in the nip portion N. The temperature adjustment range of the fixing roll 611 is set with reference to the temperature in the case where the fixing process is applied to a thin sheet. The temperatures of the support rolls 612, 613 (the temperature of the fixing belt 610) in the case of a thick sheet are set in consideration of the quantity of heat captured by the fixing roll 611 in which the temperature adjustment range is narrow (namely, the temperature is low in the case of a thick sheet).

Based on this concept, the temperature of the fixing roll 611 is controlled by the roll-temperature controlling portion 41R to 150° C. in the case of a thin sheet, and to 170° C. in the case of a thick sheet. The temperatures of the support rolls 612, 613 are controlled by the belt-temperature controlling portion 41B to 150° C. in the case of a thin sheet, and 250° C. in the case of a thick sheet. Namely, in the case of a thin sheet, the fixing belt 610 is heated by the fixing roll 611 and the support rolls 612, 613 to 150° C., and, in the case of a thick sheet, heated mainly by the support rolls 612, 613 to 250° C.

When the sheet kind is to be changed from a thin sheet to a thick sheet, the temperature of the fixing roll 611 is controlled by the roll-temperature controlling portion 41R to be raised from 150° C. to 170° C., and the temperatures of the support rolls 612, 613 which take care of the temperature of the fixing belt 610 are controlled by the belt-temperature controlling portion 41B to be raised from 150° C. to 250° C.

Figure 7:
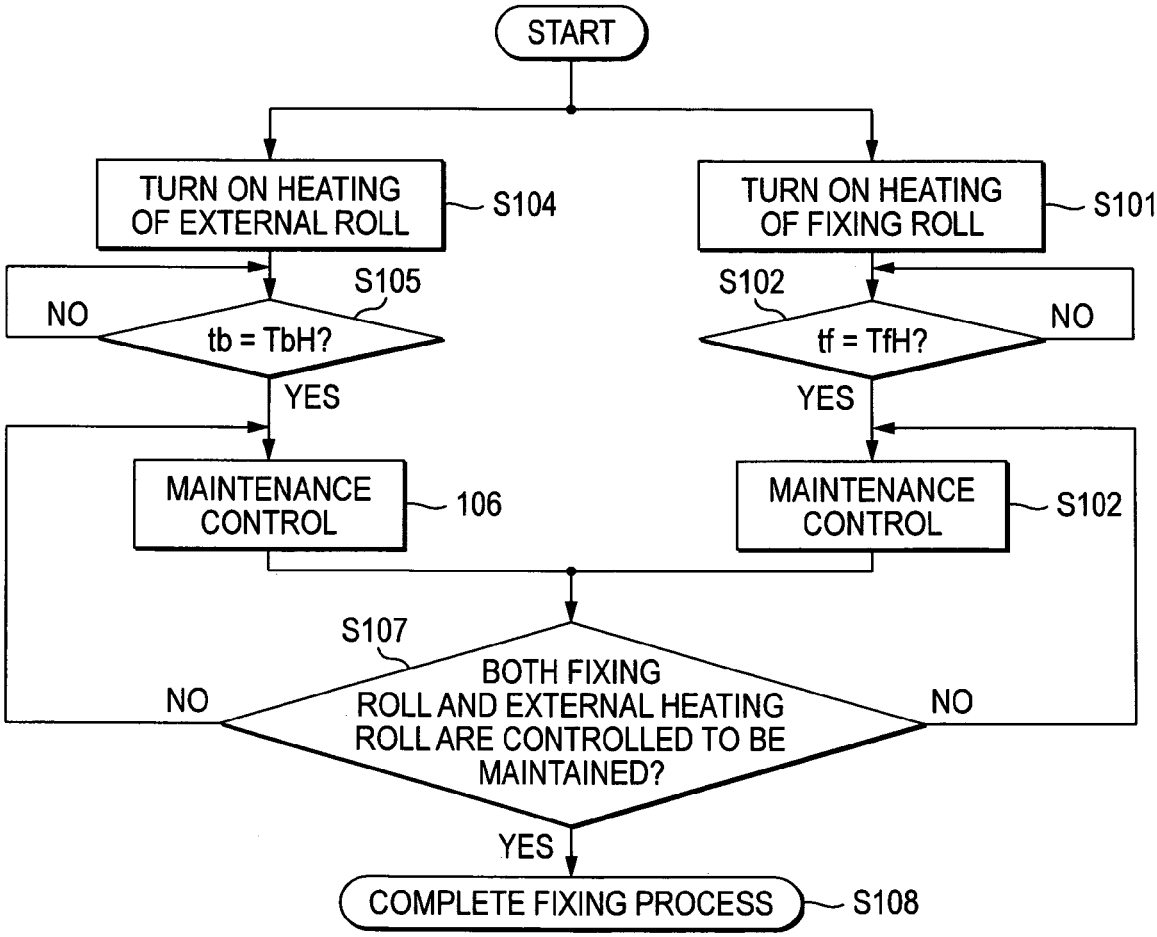
FIG. 7 is a flowchart of a control of switching from a thin sheet to a thick sheet by a temperature controlling portion.

FIG. 7 shows a flowchart of the control of switching from a thin sheet to a thick sheet by the temperature controlling portion 41 (the roll-temperature controlling portion 41R and the belt-temperature controlling portion 41B). In the flowchart, the support roll 612 and the support roll 613 are shown with generally referring as an external heating roll. The reference numerals of the components in the description are identical with those of FIGS. 1 to 6.

When the kind of the recording sheet P is to be changed from a thin sheet to a thick sheet, under the control of the roll-temperature controlling portion 41R, the halogen heater 616*a* is energized to heat the fixing roll 611 (S101), it is determined that the temperature tf of the fixing roll 611 reaches TfH: 170° C. which is the set temperature for the case of a thick sheet (S102), and a maintenance control of maintaining the set temperature TfH is performed (S103). Under the control of the belt-temperature controlling portion 41B, the halogen heater 616*b* is energized to heat the support roll 612, and the halogen heater 616*c* is energized to heat the support roll 613 (S104), it is determined that the temperatures tb of the rolls reach TbH: 250° C. which is the set temperature for the case of a thick sheet (S105), and a maintenance control of maintaining the set temperature TbH is performed (S106). Then, it is determined that the fixing roll 611, and the support rolls 612, 613 are in the respective maintenance control states (S107), and preparation for the fixing process is completed (S108).

As a result of the control, the fixing roll 611 having the large heat capacity can be set to the set temperature for a short time period because only the temperature rise of 20° C. is requested. Although the temperature rise of 100° C. is required in the support rolls 612, 613, the support rolls 612, 613 can be set to the set temperature for a short time period because they have the small heat capacity.

By contrast, when the recording sheet P is to be changed from a thick sheet to a thin sheet, under the control of the roll-temperature controlling portion 41R, the temperature of the fixing roll 611 is lowered from 170° C. to 150° C., and the temperatures of the support rolls 612, 613 are lowered by the control of the belt-temperature controlling portion 41B from 250° C. to 150° C.

Figure 8:
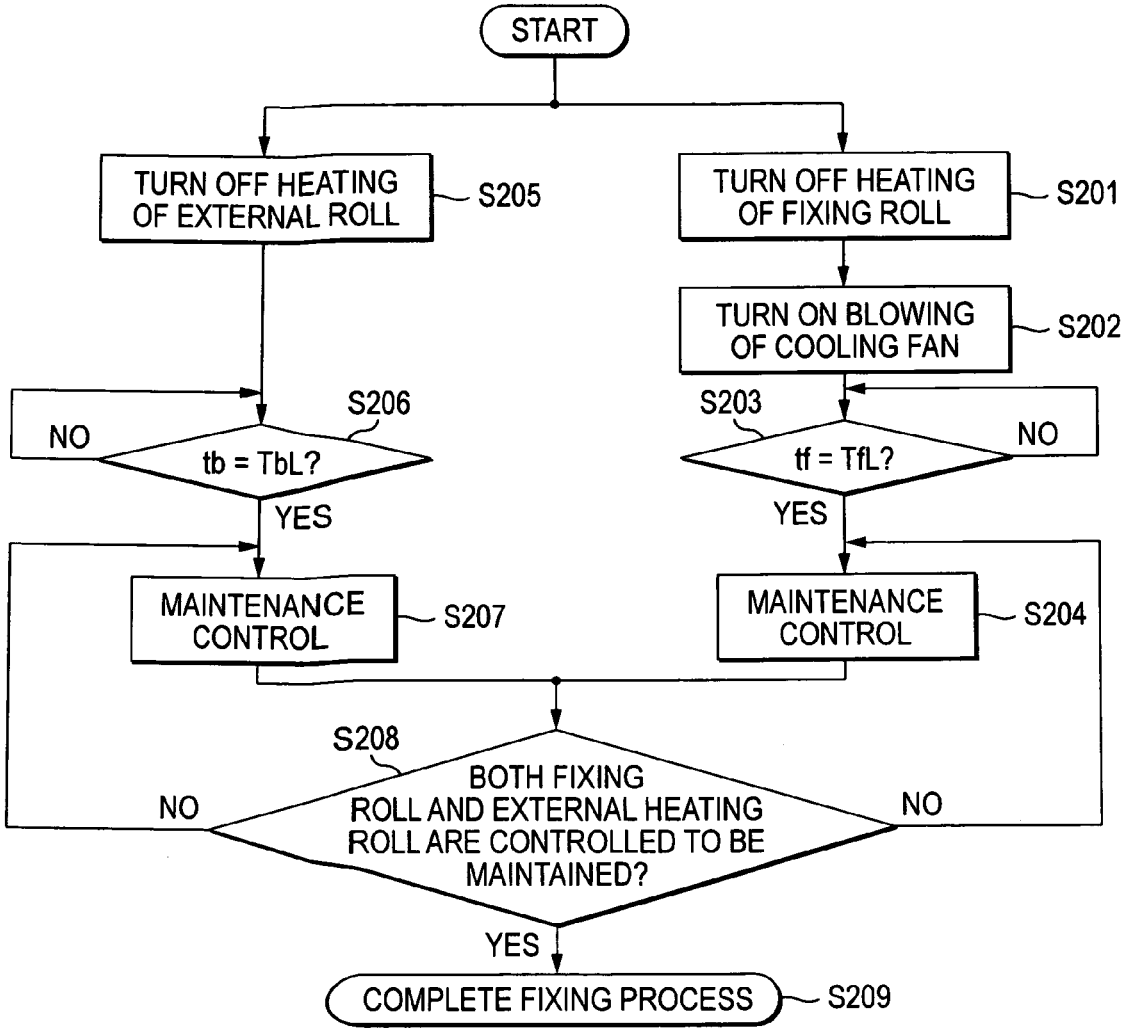
FIG. 8 is a flowchart of a control of switching from a thick sheet to a thin sheet by the temperature controlling portion.

FIG. 8 shows a flowchart of the control of switching from a thick sheet to a thin sheet by the roll-temperature controlling portion 41R and the belt-temperature controlling portion 41B. In the same manner as the case of FIG. 7, in the flowchart, the support roll 612 and the support roll 613 are shown with generally referred to as an external heating roll. The reference numerals of the components in the description are identical with those of FIGS. 1 to 6.

When the recording sheet P is to be changed from a thick sheet to a thin sheet, under the control of the roll-temperature controlling portion 41R, the energization of the halogen heater 616*a* is interrupted to stop the heating of the fixing roll 611 (S201), and the cooling fans 620 are driven (S202) to cool the fixing roll 611. Then, it is determined that the temperature tf of the fixing roll 611 is lowered to TfL: 150° C. which is the set temperature for the case of a thin sheet (S203), and a maintenance control of maintaining the set temperature TfL is performed (S204). Under the control of the belt-temperature controlling portion 41B, the energization of the halogen heater 616*b* is interrupted to stop the heating of the support roll 612, and that of the halogen heater 616*c* is interrupted to stop the heating of the support roll 613 (S205), and the support rolls 612, 613 are naturally cooled. Then, it is determined that the temperatures tb of the support rolls 612, 613 are lowered to TbL: 150° C. which is the set temperature for the case of a thin sheet (S206), and a maintenance control of maintaining the set temperature TbL is performed (S207). Then, it is determined that the fixing roll 611, and the support rolls 612, 613 are in the respective maintenance control states (S208), and preparation for the fixing process is completed (S209).

As a result of the control, the cooling of the fixing roll 611 can be performed for a short time period because only the temperature fall of 20° C. is requested. When air is blown by the cooling fans 620 to the radiating fins 611F on the side end portions of the fixing roll 611 as in the exemplary embodiment, the cooling can be conducted very rapidly. Alternatively, natural cooling may be conducted. Although the temperature fall of 100° C. is required in the support rolls 612, 613, a long time period is not required even in the case of natural cooling because they have the small heat capacity.

Tables 1 and 2 show results of experiments in which a time period required for switching the sheet kind between a thin sheet and a thick sheet (a required time period which has elapsed until completion of preparation for fixing) was measured in configuration examples of the exemplary embodiment and comparative examples.

In the comparative examples, the temperature of the fixing belt 610 is switched by similarly controlling the temperatures of all the heating elements (the fixing roll 611 and the support rolls 612, 613), and is set to 150° C. in the case of a thin sheet, and 220° C. in the case of a thick sheet.

Table 1 shows the required time period which has elapsed until completion of preparation for fixing in the case where the sheet kind is to be changed from a thin sheet to a thick sheet. Table 2 shows the required time period which has elapsed until a waiting state is attained in the case where the sheet kind is to be changed from a thick sheet to a thin sheet. In the configuration example of Table 2, the cooling fans 620 were not used in the cooling of the fixing roll 611, and the fixing roll 611 was naturally cooled. It seems that the required time period can be further shortened when the cooling fans 620 are used in the cooling of the fixing roll 611 as in the exemplary embodiment.

TABLE 1

| | Comparative example | Configuration example |
|---|---|---|
| Fixing belt | 150° C. → 220° C. | 150° C. → 250° C. |
| Fixing roll | 150° C. → 220° C. | 150° C. → 170° C. |
| Required time period | 15 minutes | 3 minutes |

TABLE 2

| | Comparative example | Configuration example |
|---|---|---|
| Fixing belt | 220° C. → 150° C. | 250° C. → 150° C. |
| Fixing roll | 220° C. → 150° C. | 170° C. → 150° C. |
| Required time period | 20 minutes | 3 minutes |

From the experimental results, it has been ascertained that, according to the configuration of the exemplary embodiment, the required time period which has elapsed until completion of preparation for fixing in switching of the sheet kind is very shorter than that in the case (comparative example) where the temperature of the fixing belt 610 is switched by controlling all the heating elements including the fixing roll 611 to the same temperature.

Next, the fixing operation of the thus configured fixing device 60 will be described.

The recording sheet P onto which an unfixed toner image has been eletrostatically transferred in the secondary transfer station 20 (see FIG. 1) of the image forming apparatus is transported by the recording-sheet transporting mechanism 50 (see FIG. 1) toward the nip portion N of the fixing device 60 (see FIG. 3, in the direction of the arrow F). The unfixed toner image on the surface of the recording sheet P which passes through the nip portion N is fixed to the recording sheet P by the pressure and the heat which are applied mainly to the roll nip portion N1.

At this time, in the fixing device 60 of the exemplary embodiment, the heat acting on the nip portion N is supplied mainly by the fixing belt 610.

In the case of a thin sheet, the fixing belt 610 is heated by heat which is supplied from the fixing roll 611 and the support rolls 612, 613. In the case of a thick sheet which requires a large quantity of heat because of the large heat capacity, the heat energy is fed adequately and rapidly to the fixing belt 610 from the support rolls 612, 613. According to the configuration, even when the process speed is high, for example, 440 mm/s, it is possible to ensure a sufficient quantity of heat in the nip portion N, and the fixing process can be performed at the same process speed irrespective of the thickness of a recording sheet P.

After passing through the roll nip portion N1, the recording sheet P is transported to the separation-pad nip portion N2.

The separation-pad nip portion N2 is formed so that the separation pad 64 is pressed against the pressing roll 62, and the fixing belt 610 is in press contact with the pressing roll 62. As shown in FIG. 4, therefore, the separation-pad nip portion N2 has a shape which is upward convexly curved by the curvature of the pressing roll 62, in contrast to that the roll nip portion N1 has a shape which is downward convexly curved by the curvature of the fixing roll 611.

Consequently, the recording sheet P which has been heated and pressed by the curvature of the fixing roll 611 in the roll nip portion N1 is changed in traveling direction in the separation-pad nip portion N2, to the curvature which is due to the pressing roll 62, and which is oriented in the opposite direction. At this time, microslip is caused between the toner image on the recording sheet P and the surface of the fixing belt 610. Therefore, the adhesion force between the toner image and the fixing belt 610 is weakened, and a state where the recording sheet P is easily separated from the fixing belt 610 is produced. Consequently, the separation-pad nip portion N2 corresponds to a step of preparation for sure separation in a final separation step.

In the exit of the separation-pad nip portion N2, the fixing belt 610 is transported so as to twine around the separation pad 64, and hence the transporting direction of the fixing belt 610 is abruptly changed there. Namely, the fixing belt 610 moves along the outer side face 64*b* of the separation pad 64, and hence the fixing belt 610 is largely bent. Therefore, the recording sheet P in which the adhesion force with the fixing belt 610 has been weakened in the separation-pad nip portion N2 is enabled to perform self-stripping from the fixing belt 610 by the stiffness of the recording sheet P itself.

In this way, at the timing when the recording sheet P leaves the separation-pad nip portion N2, the recording sheet is stably curvature-separated from the fixing belt 610.

Then, the recording sheet P which has been separated from the fixing belt 610 is discharged to the outside of the apparatus by sheet discharge guides 65 and sheet discharging rolls 66, thereby completing the fixing process.

As described above, in the fixing device 60 of the exemplary embodiment, the fixing belt module 61 in which the fixing belt 610 serving as a heating member is mounted on and tensioned by the plural rolls including the fixing roll 611 is used. Even when the image forming apparatus 1 (see FIG. 1) is speeded up, therefore, a predetermined fixing temperature in the fixing device 60 can be always maintained. Furthermore, the temperature droop phenomenon in which the fixing temperature drops in a starting period of a fast fixing operation can be prevented from occurring. Therefore, a large number of fixed images of high quality can be provided in a short time period.

In addition, temperature adjustment corresponding to the property of a recording sheet P such as the thickness is rapidly conducted, and a fixing process can be performed rationally and efficiently at a constant process speed irrespective of the property of a recording sheet P.

The invention is not restricted to the above-described exemplary embodiment. In the exemplary embodiment, the invention is applied to a color image forming apparatus of the so-called tandem type. It is a matter of course that the invention may be applied to, for example, a color image forming apparatus using a rotary developing device, or a monochrome copier.

The configuration where the pressing roll 62 is used as a pressing unit which is placed to be in press contact with the fixing belt module 61 has been described. Alternatively, the invention may be applied to a configuration where a press belt module in which a press belt is mounted on and tensioned by plural rolls is used as a pressing member.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device that fixes a toner image on a recording medium, comprising:

a rotatable fixing roll member;

a rotatable support roll member;

a fixing belt member that is rotated while being mounted on and tensioned by the fixing roll member and the support roll member;

a roll heating unit that heats the fixing roll member;

a belt heating unit that heats the fixing belt member;

a pressing member that is in press contact with a portion of the fixing roll member, around which the fixing belt member is wound, to form a nip portion;

a temperature controlling device that controls and drives the roll heating unit and the belt heating unit, the temperature controlling device controlling the fixing roll member and the fixing belt member to be different temperatures; and a separating member that is interposed between the fixing belt member and the fixing roll member in a downstream side of the nip portion, to cause the fixing belt member to be bent with a predetermined curvature.

2. The fixing device according to claim 1, wherein the pressing member is a pressing roll member that comprises an elastic layer on a surface.

3. The fixing device according to claim 1, wherein the temperature controlling device is configured such that set temperatures of the fixing roll member and the fixing belt member are changeable, and a changing range of the set temperature of the fixing roll member is set to be narrower than a changing range of the set temperature of the fixing belt member.

4. The fixing device according to claim 3, wherein the set temperature of the fixing roll member is initially fixed to a vicinity of a lowest temperature that is set on the basis of a property of the recording medium to be used.

5. The fixing device according to claim 3, wherein the changing range of the set temperature of the fixing roll member is in a range of about 20° C.

6. The fixing device according to claim 3, wherein the changing range of the set temperature of the fixing belt member is in a range of about 100° C.

7. The fixing device according to claim 1, further comprising a cooling unit that cools the fixing roll member.

8. The fixing device according to claim 7, wherein the cooling unit comprises a radiating fin that is disposed on an end face portion of the fixing roll member.

9. The fixing device according to claim 8, further comprising a cooling fan that blows air to the radiating fin.

10. An image forming apparatus comprising:

a toner image forming unit that forms a toner image;

a transferring unit that transfers the toner image formed by the toner image forming unit onto a recording medium; and a fixing device that fixes the toner image transferred onto the recording medium to the recording medium, the fixing device comprising:

a rotatable fixing roll member;

a rotatable support roll member;

a roll heater that heats the fixing roll member;

a belt heater that heats the support roll member;

a fixing belt member that is rotated while being mounted on and tensioned by the fixing roll member and the support roll member;

a pressing roll member comprising an elastic layer on a surface that is in press contact with a portion of the fixing roll member, around which the fixing belt member is wound, to form a nip portion; and a temperature controlling device that controls and drives the roll heater and the belt heater, the temperature controlling device independently controlling temperatures of the fixing roll member and the fixing belt member and being configured such that set temperatures of the fixing roll member and the fixing belt member are changeable, and a changing range of the set temperature of the fixing roll member is set to be narrower than a changing range of the set temperature of the fixing belt member.

11. The image forming apparatus according to claim 10, wherein the changing range of the set temperature of the fixing roll member is a range of about 100° C.

12. The image forming apparatus according to claim 10, wherein the changing range of the set temperature of the fixing belt member is a range of about 100° C.

13. The image forming apparatus according to claim 10, further comprising a cooling unit that cools the fixing roll member.

14. The image forming apparatus according to claim 13, wherein the cooling unit comprises a radiating fin that is disposed on an end face portion of the fixing roll member.

15. The image forming apparatus according to claim 14, further comprising a cooling fan that blows air to the radiating fin.

* * * * *